US006161655A

United States Patent [19]

Lejon et al.

[11] Patent Number: 6,161,655

[45] Date of Patent: Dec. 19, 2000

[54] NON-CONTACT ELEVATOR CALL BUTTON

[75] Inventors: Xavier Lejon; Gerard Sirigu, both of Gien; Christophe Durand, Cernoy en Berry, all of France

[73] Assignee: Otis Elevator Company, Farmington, Conn.

[21] Appl. No.: 09/220,465

[22] Filed: Dec. 23, 1998

[51] Int. Cl.[7] ..... B66B 3/00

[52] U.S. Cl. ..... 187/392; 187/388

[58] Field of Search ..... 187/380, 383, 187/385, 388, 389, 391, 392, 393

[56] References Cited

U.S. PATENT DOCUMENTS

| | | | |
|---|---|---|---|
| 4,044,860 | 8/1977 | Kaneko et al. | 187/29 R |
| 4,800,368 | 1/1989 | Wisner | 340/567 |
| 4,839,631 | 6/1989 | Tsuji | 187/105 |
| 4,874,063 | 10/1989 | Taylor | 187/130 |
| 4,915,197 | 4/1990 | Schroeder | 187/121 |
| 5,420,430 | 5/1995 | Trett | 187/317 |
| 5,487,451 | 1/1996 | Hughes et al. | 187/392 |
| 5,698,824 | 12/1997 | Platt | 187/317 |
| 5,914,466 | 6/1999 | Durand | 187/395 |

FOREIGN PATENT DOCUMENTS 6-305651 11/1994 Japan .

*Primary Examiner*—Jonathan Salata

[57] ABSTRACT

An elevator call button transmits infrared radiation into the space adjacent an elevator, and a call request is recognized by infrared radiation reflected from a potential passenger to an infrared receiver. Thus not only is contact with the button not required, the use of a finger or like-sized object is not required in order to place a call.

6 Claims, 2 Drawing Sheets

NON-CONTACT ELEVATOR CALL BUTTON

TECHNICAL FIELD

This invention relates to an elevator call button in which electromagnetic radiation is reflected from a potential passenger toward a detector, thereby to indicate the presence of a potential passenger in the vicinity of the call button, and the corresponding intent to place a call for service.

BACKGROUND ART

A wide variety of elevator hall call buttons are known in the art. Many of these utilize micro-stroke mechanical switches, others use proximity sensing, and still others use optical patterns. However, call buttons known to the art are complicated mechanical structures having a large number of parts, thereby being costly to manufacture in contrast with the function served, and being subject to mechanical wear. Buttons known to the art have ridges and crevices which not only accumulate grime and bacteria but also make it difficult to clean them. The foregoing problems are compounded in doctor's offices and hospitals, as well as in factories where dirty work is performed, since bacteria and filth may be passed from one passenger to the button and hence to other passengers. All of the buttons known in the art require some sort of contact, even in the so-called proximity sensing types. In order to register a call, therefore, a thumb, finger or other equally sized object must actually be targeted directly on the button. This can be extremely difficult when carrying bundles and the view of one's own hands is obscured, or when the fingers cannot be made free. Similarly, locating the precise position of a call button so as to press or contact it is a very difficult task for the visually impaired. Maintenance costs for buttons with moving parts is very high, and the opportunity for damage due to vandalism and abusive use is increased. The ability to tailor the aesthetic appearance of hall call buttons in order to suit architectural design can be extremely difficult when it necessitates altering the mechanical structure thereof.

DISCLOSURE OF INVENTION

Objects of the invention include provision of an elevator call button which does not have to be touched in order to be operated, which is easily rendered with substantially flush facing, which is readily adapted to suit various design needs, which has no moving parts, needs no maintenance, and does not invite abusive use, and which can be mass produced at relatively low cost.

According to the present invention, an elevator hall call button includes an electromagnetic transmitter which emits radiation into the environmental space adjacent one or more elevators, with an electromagnetic detector to sense radiation reflected from potential passengers in the vicinity of the call button. In one embodiment, the electromagnetic radiation is infrared. The invention may be practiced utilizing light emitting diodes and photodetectors. The invention may be disposed on the wall of an elevator corridor, or on a kiosk disposed in the vicinity of one or more elevators.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
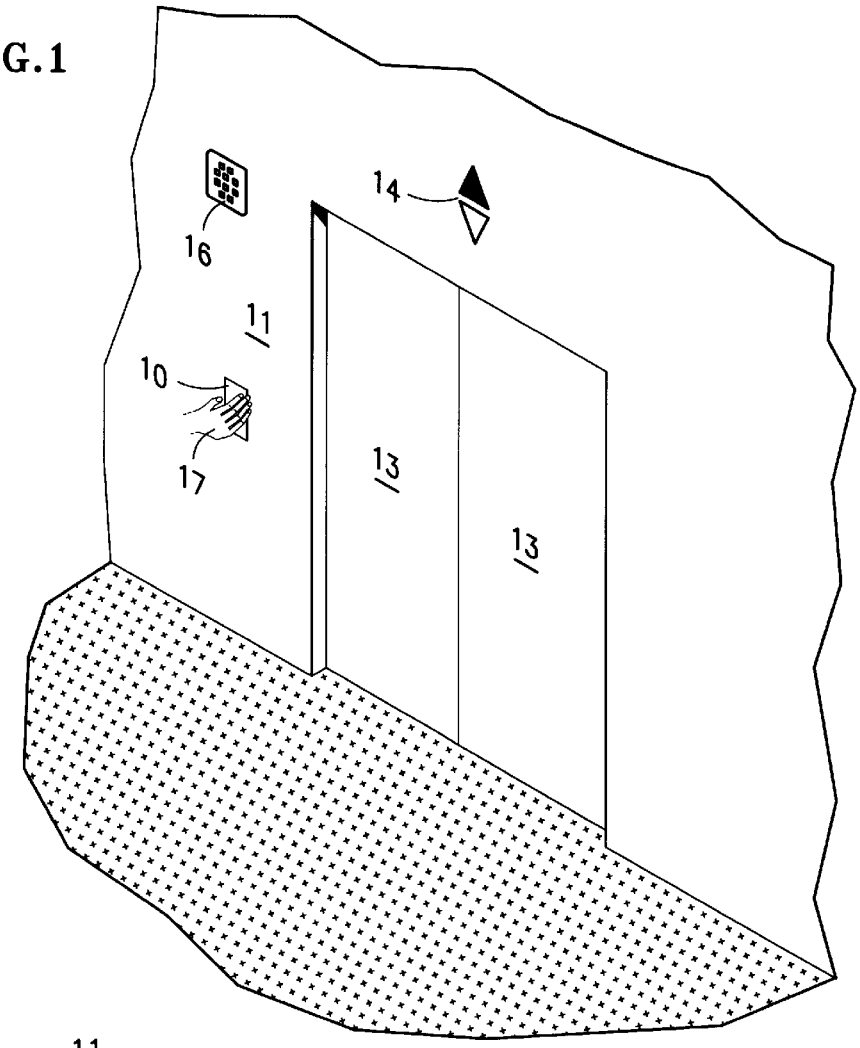
FIG. 1 is a simplified, stylized, partial perspective view of an elevator door with a call button according to the present invention.

Referring to FIG. 1, an elevator call button 10 disposed within the wall 11 of an elevator corridor adjacent the doors 13 of an elevator (of an elevator corridor). The elevator may have the usual up and down lanterns 14 and an enunciator 16 to provide an audible indication of the registration of a call request, or any other queues to the passengers. In FIG. 1, the call button 10 is seen being operated by the hand 17 of a potential passenger.

Figure 2:
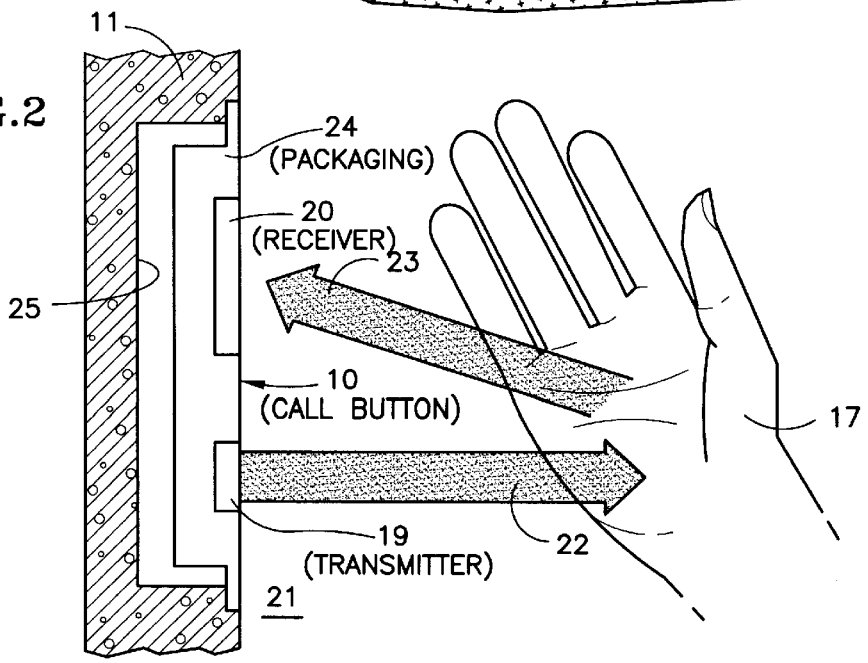
FIG. 2 is a simplified, stylized, partial side elevation view of an elevator button of the invention being operated by the hand of a potential passenger.

In FIG. 2, it is shown that the hand 17 need not touch the call button 10 since infrared radiation from an electromagnetic transmitter 19 will be reflected off the hand 17 to an electromagnetic receiver 20 through the space 21 of the elevator corridor, as shown by arrows 22, 23. The call button 10 may include packaging 24, which, although simpler than that known hereinbefore, is conventional, and may fit into a conventional void 25 within the wall 10.

Figure 3:
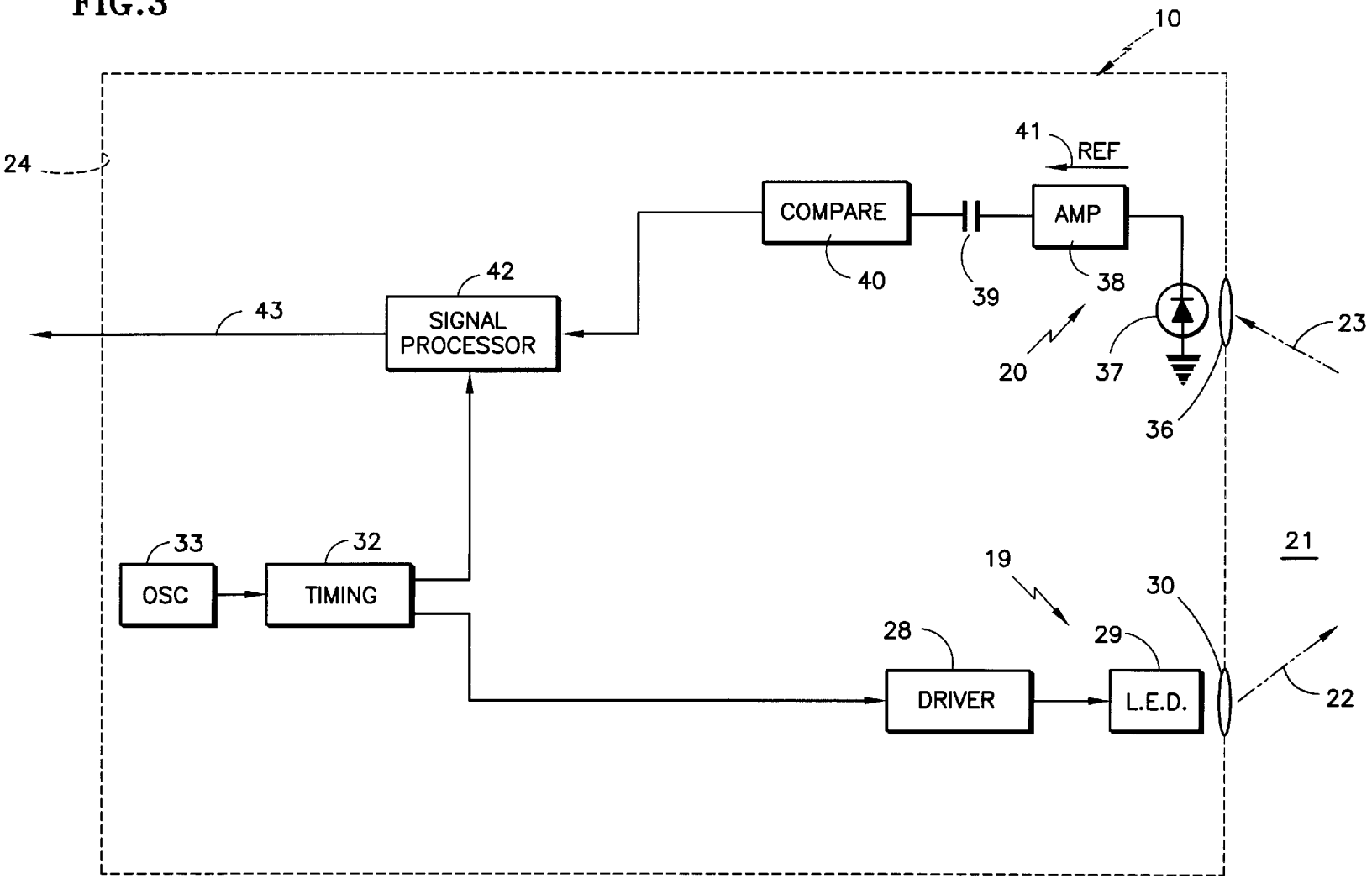
FIG. 3 is a simplified schematic block diagram of exemplary apparatus for practicing the present invention.

Referring to FIG. 3, the electromagnetic transmitter 19 comprises a driver amplifier 28 that powers an LED 29 which, in this embodiment, passes infrared radiation through a lens 30 into the space 21 within the elevator corridor. The driver 28 receives pulses from a timing circuit 32 that is controlled by an oscillator 33. The electromagnetic receiver 20 comprises a lens 36, a photodiode 37, an amplifier 38, and DC isolation 39, which in this embodiment is a capacitor but which may be provided by other apparatus. The magnitude of a received signal is ignored unless it reaches a threshold magnitude, as determined by a compare circuit 40 which is provided a reference signal on a line 41 indicative of the desired threshold. Signals in excess of the threshold are passed to a signal processor 42 to determine if the signal has arrived within an acceptable window of time from the time at which a signal was transmitted through the lens 30. The signal processor 42 may also perform conventional signal conditioning so as to provide a proper elevator call request signal on a line 43 for transmission to the elevator dispatching controller. The embodiment of FIG. 3 is exemplary merely and it should be understood that other circuit arrangements can equally well be used so as to emit the transmitted electromagnetic radiation and to receive the reflected electromagnetic radiation to sense the presence of a potential passenger.

One aspect of the invention is that the call button may be adjusted to sense the presence of passengers as much as 8 centimeters (3 inches) distant from the button. With a timely indication that the presence of the passenger has been sensed (such as by lighting a conventional light within the hall button, not shown herein) or by providing an audible indication from the enunciator 16, regular users will become educated to the fact that contact is not required, thereby transferring much less filth, bacteria and mechanical stress to the call button. Of course, the infrared radiation may as well be reflected from gloves, a grocery bag, a briefcase or other article being carried, which gives the passenger extreme freedom in placing the call. Therefore, the "passenger" as used herein includes objects borne by the passenger.

In this embodiment, the call button 10 is disposed within the wall 11 of the elevator corridor. However, it may be disposed in other places as well. For instance, it may be disposed horizontally (rather than vertically) on the top face of a waist-high kiosk on the floor of the elevator corridor, such as between a bank of elevators.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator call button apparatus for an elevator having a hatchway opening into an elevator corridor, said elevator serving a plurality of floors of a building, comprising:

a plurality of elevator call buttons, there being an up-direction call button on each floor served by said elevator except the highest such floor, and a down call button on each floor served by said elevator except the lowest such floor;

each of said buttons comprising:

an electromagnetic transmitter disposed in a surface adjacent the elevator corridor for transmitting electromagnetic radiation into the space of the elevator corridor;

an electromagnetic receiver disposed in said surface in the vicinity of said transmitter, thereby to receive electromagnetic radiation of said transmitter reflected by a passenger placed in proximity with said elevator call button; and circuitry responsive to said electromagnetic receiver for providing an elevator call request signal, in a direction corresponding to said button, in response to said receiver receiving electromagnetic radiation reflected from a passenger.

2. A call button according to claim 1, wherein:

said electromagnetic radiation is infrared.

3. A call button according to claim 1 wherein:

said electromagnetic transmitter comprises an LED.

4. A call button according to claim 3 wherein:

said electromagnetic transmitter comprises an LED emanating radiation through a lens into said space.

5. A call button according to claim 1 wherein:

said electromagnetic receiver comprises a photodiode.

6. A call button according to claim 5 wherein:

said electromagnetic receiver comprises a photodiode receiving radiation from said space through a lens.

* * * * *